United States Patent [19]

Potts

[11] 4,258,845

[45] Mar. 31, 1981

[54] ACTIVATOR CLOSURE FOR TWO-COMPARTMENT VIAL

[75] Inventor: Alan W. Potts, Portage, Mich.

[73] Assignee: The Upjohn Company, Kalamazoo, Mich.

[21] Appl. No.: 96,263

[22] Filed: Nov. 20, 1979

[51] Int. Cl.[3] ..... B65D 81/32

[52] U.S. Cl. ..... 206/221; 215/DIG. 8

[58] Field of Search ..... 206/221, 219; 215/6, 215/DIG. 8, 249, 247

[56] References Cited

U.S. PATENT DOCUMENTS

| | | | |
|---|---|---|---|
| 3,087,638 | 4/1963 | Loper | 206/221 |
| 4,089,432 | 5/1978 | Crankshaw | 215/6 |

*Primary Examiner*—Donald F. Norton

*Attorney, Agent, or Firm*—Blanchard, Flynn, Thiel, Boutell & Tanis

[57] ABSTRACT

A closure structure for a two-compartment vial having an open neck at one end thereof with an annular rim encircling the neck at the free end thereof. The closure structure includes a stopper which extends into the neck and has a protruding portion of reduced diameter. The closure structure also includes a cap having a gripping portion sleeved upon the neck for gripping the rim. A sleeve portion of the cap snugly and slidably embraces the protruding portion of the stopper, and is connected to the gripping portion by a fracture region. The sleeve portion is movable with the protruding portion into the neck. Interengageable lock structure is provided on the sleeve and protruding portions for positively resisting inward movement of the stopper relative to the sleeve portion.

6 Claims, 7 Drawing Figures

ACTIVATOR CLOSURE FOR TWO-COMPARTMENT VIAL

FIELD OF THE INVENTION

This invention relates to a closure structure for a two-compartment vial and, more particularly, to a type thereof having a stopper received into the neck of the vial and a cap substantially surrounding the stopper, the cap and stopper having interengaging locking means whereby movement of said stopper relative to the cap, inwardly into the vial, is positively opposed.

BACKGROUND OF THE INVENTION

Many closure structures have been developed for two-compartment vials with the primary object thereof being the provision of means for easily actuating the vial so that the content of the two chambers therein can be mixed and used. A number of closure structures have been developed for similar purposes and some thereof are disclosed in U.S. Pat. Nos. 4,089,432, 4,180,173 and 4,194,640 and U.S. Pat. application Ser. No. 871,398 filed Jan. 23, 1978 all of which are assigned to the assignee of this application, and U.S. Pat. No. 2,908,274.

However, these patents and patent applications fail to disclose the combination of elements which are capable of producing the desired results achieved by the invention disclosed and claimed in this application. Specifically, they have not disclosed a closure structure having a stopper and a cap which, when combined, positively control the movement of the stopper relative to the vial during activation thereof, whereby the center plug of the two-compartment vial can be displaced in order to permit mixing of the contents of the vial without risking contamination of said contents.

Accordingly, a primary object of this invention is the provision of a closure structure for a two-compartment vial including a stopper means and cap means providing interengageable lock means whereby movement of the stopper means into the vial, during activation thereof, is positively limited and removal of the stopper means from within the vial thereafter is positively prevented.

A further object of this invention is the provision of a closure structure, as aforesaid, wherein the stopper means has a projecting portion of reduced diameter and the cap means has a sleeve portion snugly but slidably surrounding the projecting portion, and wherein the lock means is disposed upon and between said projecting portion and said sleeve portion, the sleeve portion being connected to the vial and being movable relative to the stopper means toward the vial before the interlocking engagement thereof occurs.

SUMMARY OF THE INVENTION

The objects and purposes of the invention have been met by providing a vial and closure structure wherein the closure structure is comprised of stopper means and cap means, and wherein the stopper means is partially inserted into the neck of the vial and the cap means has a portion securely connected to the neck of the vial. The stopper means has a projecting portion which is surrounded by a sleeve portion of said cap means which is disconnectible from the gripping portion of the cap means for movement with the stopper means into the vial when the closure structure is activated. Locking means connects the sleeve portion to the projecting portion of the stopper means to positively limit movement of the stopper means relative to the sleeve portion into the vial. Other lock means may be provided for preventing dislodgment of the stopper means from the vial after the closure structure has been activated.

Other objects and purposes of this invention will become apparent to persons familiar with this type of device upon reading the following specification and examining the accompanying drawings.

Figure 1:
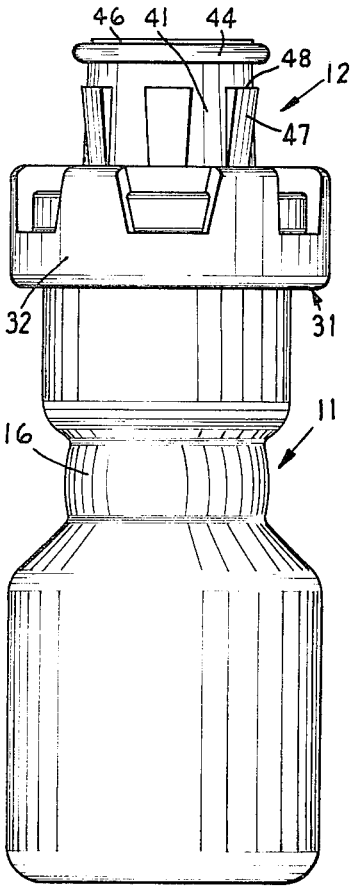
FIG. 1 is a side elevational view of a two-compartment vial and a closure structure therefor embodying the invention.
Figure 2:
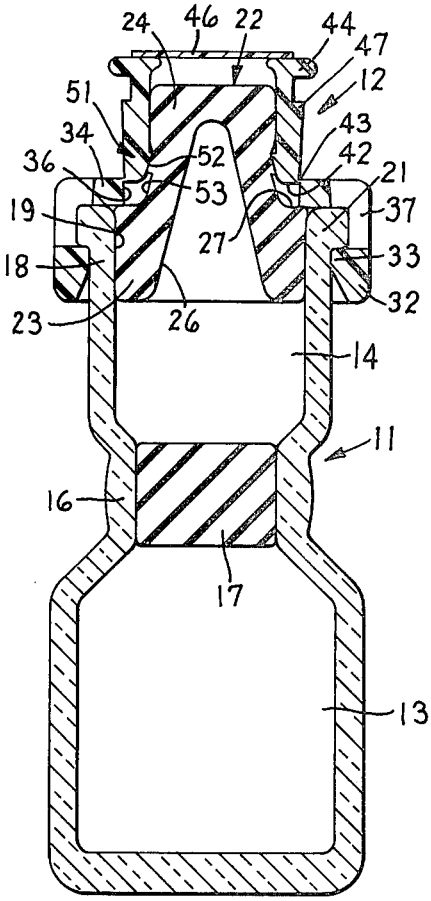
FIG. 2 is a central sectional view of the vial shown in FIG. 1.

For convenience in description, the terms "upper" and "lower" and words of similar import will have reference to the vial and closure structure as appearing in FIGS. 1 and 2. The terms "inner", "outer" and derivations thereof will have reference to the geometric center of the vial and closure structures.

DETAILED DESCRIPTION

FIGS. 1 and 2 illustrate a two-compartment mixing vial 11 having a closure structure 12, as constructed according to the present invention, associated therewith. The vial 11 defines therein two interior compartments 13 and 14 which are separated by a constriction 16 into which a moisture barrier or plug 17 is inserted during the filling operation. The vial had an annular neck portion 18 at one end thereof which defines an annular opening 19 for communication with the interior of the vial, specifically the upper compartment 14. The neck portion 18, in the illustrated embodiment, is of the same interior diameter as the upper compartment 14, although under some circumstances the neck portion may be of a reduced diameter. The neck portion 18, adjacent the free end thereof, has an outwardly projecting annular rim 21 disposed in encircling relationship.

In a typical utilization of the vial, a lyophilized medication is placed in the lower compartment 13, and the upper compartment 14 is filled with a solvent.

The closure structure 12 includes a resiliently flexible stopper 22 which is preferably an elongated cylindrical member fabricated from an elastomer which is impervious to the solvent contained in the upper compartment. The stopper 22, at the lower end thereof, has an annular portion 23 which is sealingly seated within the neck 18. To improve the sealing qualities between the portion 23 and the neck 18, said portion 23 may be provided with a plurality, here three, of spaced annular ridges 28 (FIG. 6) if desired.

Stopper 22 also includes an annular protruding portion 24 which projects coaxially outwardly beyond the sealing portion 23, the protruding portion 24 being of reduced diameter and projecting outwardly beyond the free end of the vial. The sealing portion 23, at its interface with the smaller diameter protruding portion 24, defines an upwardly facing shoulder 27 which is substantially flush with the axial end face of the vial neck when the portion 23 is properly seated within the neck.

The stopper 22 is also preferably provided with a deep conical recess 26 opening into the upper compartment 14 so that a needle of a conventional syringe can be easily axially inserted through the stopper for communication with the interior of the vial.

The closure structure 12 also includes a cap 31 which is normally made in one piece by molding from a plastic material, such as polyethylene, so that it has some resilience and some flexibility but is relatively rigid. The cap 31 includes an annular ringlike gripping portion 32 which surrounds the neck portion 18 and extends downwardly beyond the rim 21. This gripping portion 32 has a plurality of substantially uniformly spaced, radially inwardly extending projections 33, the inner surfaces of which define a circle having a diameter somewhat less than the outside diameter of the rim 21. These projections 33 are positioned so that they resiliently snap into position directly under the rim 21 to effect a secure mechanical locking of the cap onto the vial.

The gripping portion 32 also has, at its upper end, an annular plate portion 34 which overlies the upper axial end of the neck. This plate portion 34 has an annular configuration and defines an inner opening 36 of a diameter less than the neck opening 19, whereby the plate portion 36 thus projects radially inwardly so as to overlap the stopper shoulder 27, thereby positively retaining the stopper within the vial neck. The gripping portion 32 may, as illustrated, be provided with several circumferentially spaced openings 37 so as to reduce the material of the cap while at the same time provide the gripping portion 32 with the resiliency necessary to enable it to be snap-fitted onto the vial.

Cap 31 also includes a sleeve portion 41 which closely and snugly surrounds the upwardly projecting stopper portion 24. The sleeve portion 41 has the inner diameter thereof sized so as to snugly confine the stopper portion 24 to prevent undesired radial bulging thereof, while at the same time the sleeve portion 41 is axially slidably movable relative to the stopper portion 24, as explained hereinafter.

The lower end face 42 of the sleeve portion 41 is normally spaced upwardly a substantial distance from the shoulder 27, as shown in FIG. 2. The sleeve portion 41, however, adjacent the lower end thereof, is connected to the annular gripping portion 32 by means of a fracturable connection 43 which is provided therebetween. As illustrated in FIG. 2, the fracturable connection 43 joins the lower end of sleeve portion 41 to the inner edge of the annular plate portion 34. This fracturable connection 43, which is normally formed as a thin breakable annular flange, or a plurality of spaced webs, is joined between the lower end of the sleeve portion 41 and the upper surface of the plate portion 34 so as to maximize the spacing between the lower end face 42 and the shoulder 27. However, this fracturable connection 43 can also be spaced downwardly from the upper surface of the plate portion 34, such as by being located substantially midway between the upper and lower surfaces of the plate 33, provided that the fracturable connection is positioned upwardly from the lower surface of the plate portion.

An annular, radially outwardly projecting flange 44 is integral with the sleeve portion 41 at its upper end, which flange 44 has an outer diameter which is greater than the diameter of the opening 36. The open upper end of the sleeve portion 41 can be suitably sealingly closed by a removable dust shield 46.

The outside surface of sleeve portion 41 is preferably provided with a plurality of parallel and substantially uniformly spaced ribs 47 which extend axially of and converge with the sleeve portion toward the gripping portion 32. The diameter of the circle defined by the lower ends of said ribs 47 is approximately equal to the inside diameter of the circular opening 36. However, the circle defined by the upper ends of said ribs 47 is somewhat larger than the inside diameter of this opening 36. The ribs 47, which terminate somewhat short of the upper end of the sleeve portion and define shoulders at the upper ends thereof, thus function as locking elements for positively retaining the sleeve portion 41 in the activated position illustrated by FIG. 5.

The closure structure 12 also includes a lock structure 51 which coacts between the stopper and the cap, and specifically between the sleeve portion 41 and the stopper portion 24, for preventing the stopper from being slidably displaced relative to the cap in a direction toward the interior of the vial. For this purpose, the lock structure 51 includes an annular lock ring or flange 52 which is formed on the lower end of the sleeve portion 41 and projects radially inwardly from the interior diameter thereof. This annular lock ring 52 has, when viewed in cross section, a toothlike configuration such that the inner surface tapers inwardly as it projects upwardly, and terminates in an upwardly facing shoulder, the lock ring thus being effective solely in one direction so as to thereby enable the sleeve portion 41 to be slidably displaced downwardly relative to the stopper portion 24. The lock structure 51 also includes an undercut annular groove 53 formed in the stopper portion 24 directly above the shoulder 27, which undercut annular groove 53 terminates in a downwardly facing shoulder at its upper edge.

OPERATION

The operation of the aforesaid vial structure is believed apparent from the foregoing description. However, a brief summary of such operation will now be given.

The chamber 13 of vial 11 is filled with a lyophilized or powdered medication (not shown), the center plug 17 is inserted into the constriction 16, and a solvent (not shown) is placed in the chamber 14, all in a wellknown manner. Thereafter, the stopper 22 is inserted into the neck 18 so that the enlarged stopper portion 23 sealingly and snugly engages the inner wall of the opening 19. Thereafter the one-piece cap 31 is positioned on the vial so as to be securely connected thereto.

In the positioning of the cap 31 on the vial, the cap is axially positioned so that the stopper portion 24 is received within the sleeve portion 41, and the cap is moved axially relative to the vial so that the gripping portion 32 can be disposed in surrounding relationship to the neck 18. During this initial mounting of the cap on the vial, the lower edge of the gripping portion 32 is radially resiliently deformed so as to pass over the rim 21, following which the projections 33 snap inwardly beneath the rim to thereby mechanically secure the cap to the vial. With the projections 33 snapped under the rim 21, the upper plate portion 34 is positioned substantially in engagement with the axial end face of the vial, and the radially inner edge of the plate portion 34 projects radially inwardly so as to overlap the shoulder 27 on the stopper, whereby the stopper is thus positively retained within the vial. The cap is thus positioned as illustrated in FIG. 2, wherein the upper end of the stopper portion 24 is spaced axially downwardly from the upper end of the sleeve portion 41.

During the axial slidable mounting of the cap 31 on the vial 11, the sleeve portion 41 is moved axially downwardly over the stopper portion 24. During this movement, the locking ring 52 engages the stopper portion 24 and causes a slight compression thereof, although the engagement between the sleeve portion 41 and stopper portion 24 is of sufficiently low magnitude as to enable the locking ring 52 to be axially slidably moved downwardly therealong, at least in the one direction. When the cap is fully seated on the vial, as shown in FIG. 2, the locking ring 52 engages the stopper portion 24 at a region directly above the undercut groove 53, thereby causing a slight compression of the stopper portion.

The dust shield 46 may be secured to the upper open end of the sleeve portion 41 in sealed relationship therewith, either before or after the cap member is attached to the vial.

With the vial and closure structure assembled as illustrated in FIG. 2, the vial is thus maintained in a sealed and sterile condition, and hence can be stored for a substantial period of time.

Figure 3:
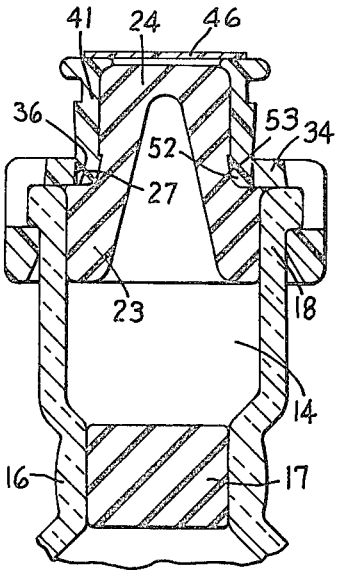
FIG. 3 is a fragment of the sectional view appearing in FIG. 2 with parts thereof in different relative positions.
Figure 7:
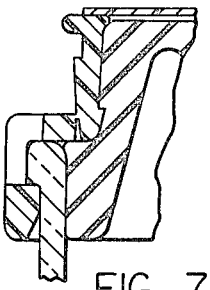
FIG. 7 is a fragment of the sectional view appearing in FIG. 2 and showing a modified cap means.
Figure 4:
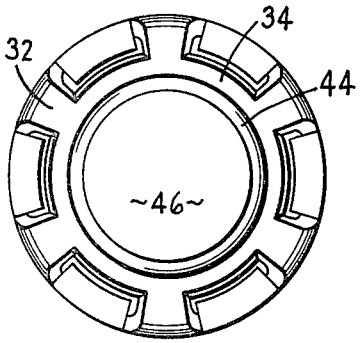
FIG. 4 is a top view of said closure structure.

When it becomes desirable to use the medication, the vial 11 is gripped within the hand so that the thumb can press against the upper end of the sleeve portion 41 and dust shield 46. By urging the sleeve portion 41 toward the vial with the thumb, the connection 43 is initially fractured and the sleeve portion 41 is moved downwardly toward the shoulder 27. During this initial movement of the sleeve portion 41, the stopper 22 remains stationary, and the locking ring 52 slides downwardly along the stopper portion 24 until the locking ring 52 enters the groove 53, which occurs substantially simultaneous with the engagement of the end face 42 with the shoulder 27, as shown in FIG. 3. Continued downward depression of the sleeve portion 41 now results in the stopper portion 23 being pressed downwardly into the vial creating hydraulic pressure within the upper compartment 14, which forces the plug 17 out of the constriction 16 so that the solvent can move into the lower compartment 13 and mix with the medication. This downward depression of the sleeve portion 41, and the accompanying depression of the stopper 22 into the vial, occurs until the flange 44 abuts against the top plate portion 34 as indicated by FIG. 5.

During the depression of the sleeve portion 41, the ramps 47 pass through the opening 36 and cause relative distortion of the sleeve portion 41 and/or gripping portion 32. However, when the sleeve portion 41 is fully depressed as indicated in FIG. 5, the ramps 47 pass beneath the lower surface of the plate portion 34 whereby the parts then resiliently snap back into their original position so that the plate 34 is thus engaged within an annular groove which is located between the flange 44 and the upper ends of the ramps 47, thereby fixedly locking the sleeve 41 in a depressed position within the vial as shown by FIG. 5. When in this fully depressed or activated position shown by FIG. 5, the locking ring 52 remains in locking engagement with the groove 53 for effectively creating a one-way lock therebetween which prevents the stopper 22 from being depressed inwardly (downwardly in FIG. 5) of the vial relative to the stationary sleeve portion 41. In this manner, a minimum volume is always maintained within the compartment 14 since the stopper can not be inserted further than the extent permitted by the cap.

Figure 5:
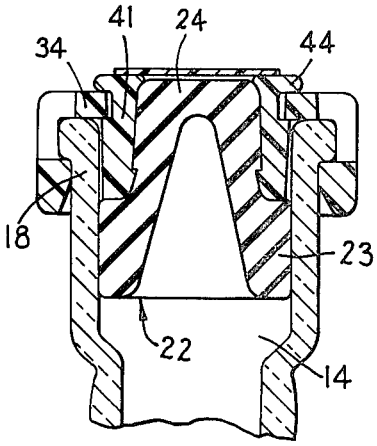
FIG. 5 is a fragment of the sectional view appearing in FIG. 2 with parts thereof in still different operating positions.

When the vial is in the activated position of FIG. 5, the stopper 22 and cap 27 are both axially fixed relative to the vial and hence can not be jointly or individually displaced axially inwardly or outwardly relative to the vial. This thus prevents reuse of the vial since the closure structure cannot be disassembled from the vial without causing destruction or damage to the closure structure. The closure structure can thus be utilized only once, and must then be disposed of after use.

Figure 6:
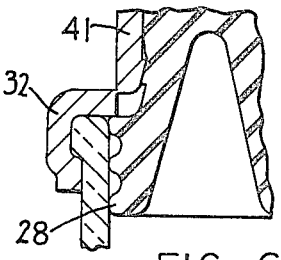
FIG. 6 is a fragment of the sectional view appearing in FIG. 2 and illustrating a modified stopper means.

While the illustrated closure structure has the cap secured to the vial by means of a snap-fit between the gripping ring and the rim, it will be appreciated that the gripping portion of the cap could be secured to the neck of the vial by other means, such as by means of a heat-shrink-fit (as shown in FIG. 6) or by a bonding of the gripping portion to the neck.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a closure structure for a two-compartment vial having an open neck at one end thereof, said closure structure including a resilient stopper for sealingly closing the open neck of said vial and a cap joined to said vial for retaining the stopper therein, said stopper including a first annular stopper portion sealingly seated within said neck and a second stopper portion coaxially aligned with and protruding outwardly of said vial from said first stopper portion, said second stopper portion being of substantially reduced diameter relative to said first stopper portion so as to define an outwardly directed shoulder at the interface therebetween, and said cap including an annular gripping portion which surrounds said neck for securing said cap to said vial, said gripping portion including an annular platelike portion which overlies the axial end face of said neck and projects radially inwardly thereof so as to radially overlap the shoulder formed on said stopper to prevent withdrawal of the stopper from the vial, the cap also including a sleeve portion which closely surrounds the second stopper portion and has the lower axial end thereof positioned opposite but spaced upwardly a selected distance from said shoulder, said sleeve portion in the vicinity of the lower end thereof being rigidly and integrally joined to said platelike portion by a fracturable connection, said sleeve portion being sized so as to be movable into the vial neck during activation, the improvement comprising one-way locking structure coacting between the sleeve portion and said stopper for preventing the stopper from being moved inwardly of the vial relative to the sleeve portion after the closure structure has been activated, said one-way locking structure permitting said sleeve portion during initial activation thereof to be axially moved relative to said second stopper portion until the lower end of said sleeve portion abuts said shoulder, said one-way locking structure becoming engaged at this latter intermediate position to prevent the stopper from being depressed inwardly of the vial independently of the sleeve portion.

2. A closure structure according to claim 1, wherein said locking structure includes an annular radially projecting locking flange positioned for cooperation with an annular groove, one of said flange and groove being provided on the inner surface of said sleeve portion adjacent the lower end thereof, and the other of said flange and groove being provided on said second stopper portion directly above said shoulder.

3. A closure structure according to claim 2, wherein said sleeve portion has a radially outwardly projecting flange associated therewith adjacent the upper end thereof, said flange being engageable with the upper surface of said platelike portion for defining the innermost position of said sleeve portion when the latter is in its fully activated position.

4. A closure structure according to claim 3, including locking means coacting between said sleeve portion and said platelike portion for securely retaining said sleeve portion within the vial neck when the sleeve portion is in its fully activated position, whereby the sleeve portion can not be withdrawn from the vial.

5. A closure structure according to any one of claims 2-4, wherein said annular flange is integral with said sleeve portion, and wherein said groove is formed in and surrounds said second stopper portion directly adjacent said shoulder.

6. A closure structure according to any one of claims 2-4, wherein said fracturable connection extends between said sleeve portion, adjacent the lower end thereof, and said platelike portion adjacent the upper surface thereof, whereby said fracturable connection is broken during the initial movement of said sleeve portion prior to the contact of the latter with the shoulder on said stopper.

* * * * *